US005515016A

United States Patent [19]

Holme et al.

[11] Patent Number: 5,515,016

[45] Date of Patent: May 7, 1996

[54] HIGH POWER DIELECTRIC RESONATOR FILTER

[75] Inventors: Stephen C. Holme, San Ramon; Slawomir J. Fiedziuszko; Yujiro Honmyo, both of Palo Alto, all of Calif.

[73] Assignee: Space Systems/Loral, Inc., Palo Alto, Calif.

[21] Appl. No.: 254,981

[22] Filed: Jun. 6, 1994

[51] Int. Cl.[6] ..... H01P 7/10; H01P 1/20

[52] U.S. Cl. ..... 333/202; 333/212; 333/219.1

[58] Field of Search ..... 333/202, 219.1, 333/212, 234

[56] References Cited

U.S. PATENT DOCUMENTS

| | | | |
|---|---|---|---|
| 4,489,293 | 12/1984 | Fiedziuszko | 333/202 |
| 4,675,630 | 6/1987 | Tang et al. | 333/212 |
| 4,692,723 | 9/1987 | Fiedziuszko | 333/212 |
| 4,939,489 | 7/1990 | Gueble et al. | 333/234 |
| 5,034,711 | 7/1991 | Hendrick et al. | 333/234 |
| 5,097,238 | 3/1992 | Suto et al. | 333/234 |
| 5,136,270 | 8/1992 | Hatanaka et al. | 333/234 |
| 5,179,074 | 1/1993 | Fiedziuszko | 333/219.1 |
| 5,221,913 | 6/1993 | Ishizaki et al. | 333/234 |
| 5,233,319 | 8/1993 | Mizan et al. | 333/219.1 |

OTHER PUBLICATIONS

S. Holme et al., "A 4 GHz Dielectric Contiguous Output Multiplexer For Satellite Applicaitons", 1993 IEEE MTT–s Digest, 1993, pp. 443–446.

*Primary Examiner*—Benny Lee
*Assistant Examiner*—Darius Gambino
*Attorney, Agent, or Firm*—Perman & Green

[57] ABSTRACT

A dielectric resonator filter has a series of cavities enclosing respective ones of a series of dielectric resonators, wherein each cavity includes a resonator support configured as a cylinder of thermally conductive, electrically insulating material such as boron nitride. The support is positioned coaxially with the resonator along a central axis of the cavity, and is located in tandem with the resonator. Physical connection of the support to the resonator is facilitated by provision of a thread along an inner surface of the support, and the provision of an outer thread on the resonator surface to be received within the thread of the support. The support is mounted to an end wall of the cavity, thereby to complete a thermally conductive path for withdrawal of heat from the resonator to the exterior of the filter. Each support is provided with windows through which tuning and/or mode coupling screws can be inserted, thereby to locate a screw behind an end surface of the resonator. The screw is supported by a sidewall of the cavity and extends radially inward of the cavity in a plane which is parallel to the resonator end surface and spaced apart from the end surface to inhibit the formation of electric discharge arcs in the case of elevated electromagnetic power. Coupling between cavities is accomplished by means of a cruciform iris.

14 Claims, 2 Drawing Sheets

HIGH POWER DIELECTRIC RESONATOR FILTER

BACKGROUND OF THE INVENTION

This invention relates to a dielectric resonator filter and, more particularly, to a resonator filter constructed with a thermally conductive, electrically insulating support for a resonator, and including a locating of tuning screws behind a resonator to accommodate increased electromagnetic field strength and power.

A dielectric resonator filter constructed of a series of dielectric resonators enclosed within metallic cavities is employed in situations requiring reduced physical size and weight of the filter. One such situation of interest is in a satellite communication system wherein such a filter is to be carried on board the satellite as a part of microwave circuitry. The reduced size of such a filter arises because the wavelength of an electromagnetic signal within a dielectric resonator is substantially smaller than the wavelength of the same electromagnetic signal in vacuum or in air. Coupling of electromagnetic power between contiguous cavities may be accomplished by means of slotted irises, as is disclosed in Fiedziuszko, U.S. Pat. No. 4,489,293, this patent describing the construction and tuning of a multiple, dielectric-loaded, cavity filter.

A problem arises in the construction of such a filter in that the tuning screws are supported by the cavity sidewalls at positions facing sidewalls of the resonators, and extend radially inward of the cavity sidewalls providing a gap between the tip of each screw and its respective resonator. Such a gap may support an electric arc in the case of elevated microwave power and, therefore, serves to limit the amount of power which can be handled by the filter. Furthermore, presently available supports which support the resonators within their respective cavities are limited in their capacity to withdraw heat from the resonators. Since increased microwave power results in increased dissipation of heat within a resonator, the resonator may become so hot as to alter its microwave characteristics resulting in degradation of the filter response. Therefore, the limited thermal conductivity of present resonator supports also serves as a limitation on the power handling capability of the filter.

SUMMARY OF THE INVENTION

The aforementioned problems are overcome and other advantages are provided by a dielectric resonator filter wherein a cylinder of thermally conductive, electrically insulating material is employed as a support for a resonator within a filter cavity, in accordance with a first feature of the invention. The resonator is constructed as a solid circular cylinder of dielectric material, and is located within a metallic, circular cylindrical cavity of the filter. In a preferred embodiment of the invention, the material of the support is boron nitride. The support is positioned coaxially with the resonator along a central axis of the cavity, and is located in tandem with the resonator. Physical connection of the support to the resonator is facilitated by provision of a thread along an inner surface of the support, and the provision of an outer thread on the resonator surface to be received within the thread of the support. The support is mounted to an end wall of the cavity, thereby to complete a thermally conductive path for withdrawal of heat from the resonator to the exterior of the filter.

In accordance with a second feature of the invention, the cylindrical structure of the support which holds the resonator is provided with windows through which tuning screws can be inserted, thereby to locate a tuning screw behind an end surface of the resonator. The tuning screw is supported by a sidewall of the cavity and extends radially inward of the cavity in a plane which is parallel to the resonator end surface and spaced apart from the end surface. The spacing between the tuning screw and the end surface of the resonator is sufficiently large so as to inhibit the formation of electric discharge arcs, even in the case of elevated electromagnetic power. The structure of the support also allows for the emplacement of coupling device behind the resonator to facilitate coupling of electromagnetic power into and out of the cavity.

In a multiple cavity filter, coupling between cavities is accomplished in a preferred embodiment of the invention by means of a cruciform iris. If it is desired to increase the number of poles in the filter response by coupling of horizontally and vertically polarized waves, a window of the support permits the insertion of a mode coupling screw at an angle of 45 degrees relative to the cross arms of the iris. It is noted also that, while the description of the invention is given for a circular cylindrical resonator, it is to be understood that the theory of the invention applies also to resonators of other shapes such as a resonator having and ellipsoidal or a square cross section, by way of example.

BRIEF DESCRIPTION OF THE DRAWING

The aforementioned aspects and other features of the invention are explained in the following description, taken in connection with the accompanying drawing wherein.

Identically labeled elements appearing in different ones of the figures refer to the same element in the different figures.

DETAILED DESCRIPTION

Figure 1:
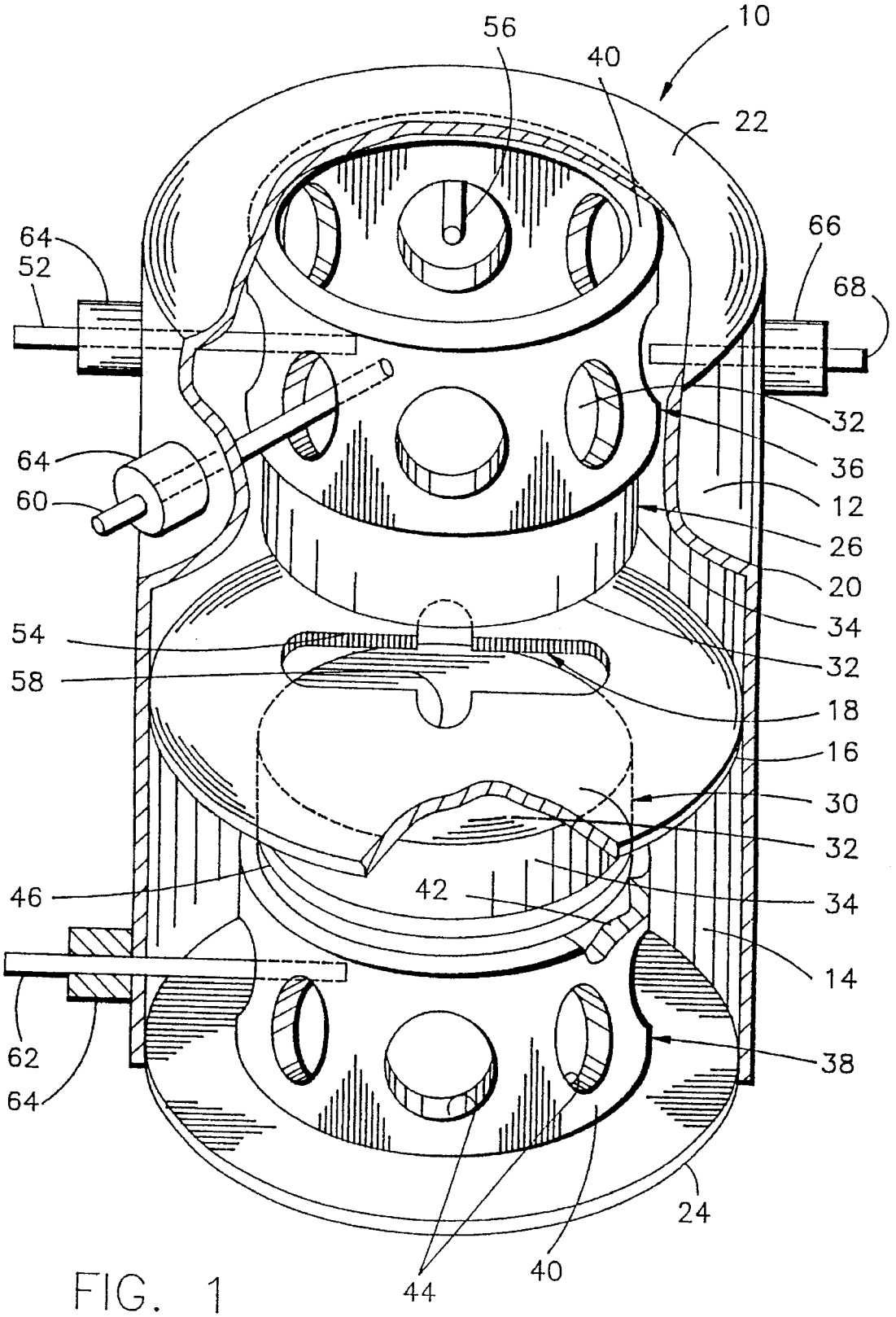
FIG. 1 shows a perspective view of a filter constructed in accordance with the invention, a portion of the filter being cut away to show interior components of the filter.
Figure 2:
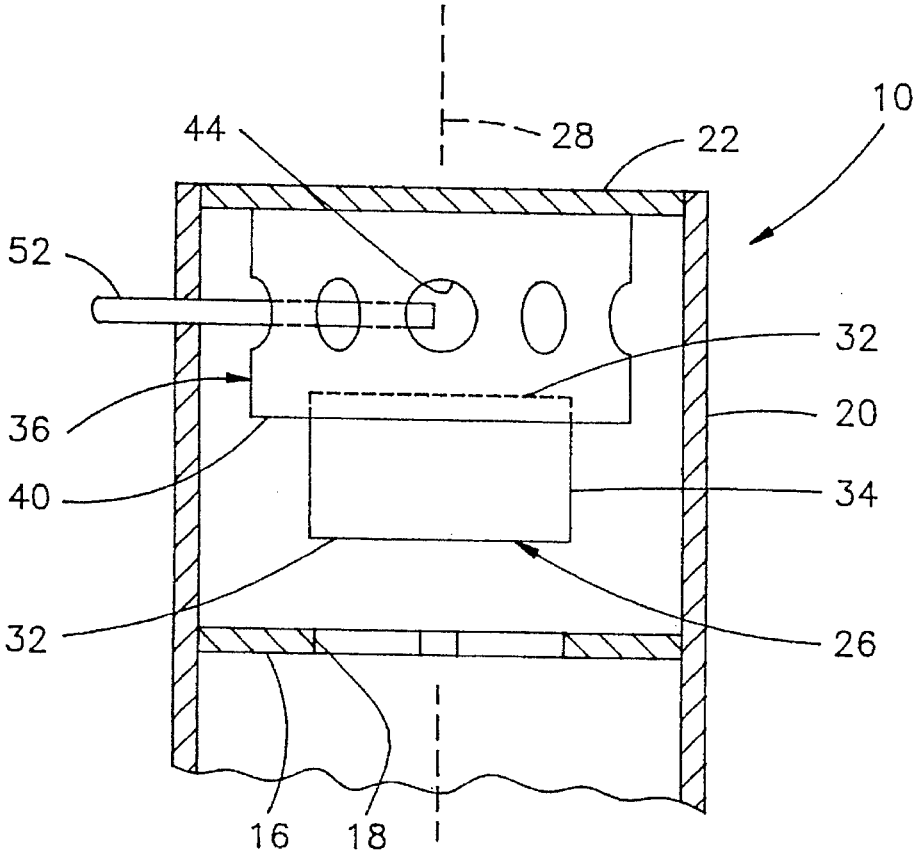
FIG. 2 is a diagrammatic side elevation view of an upper cavity of the filter of FIG. 1 showing the location of a tuning screw.
Figure 3:
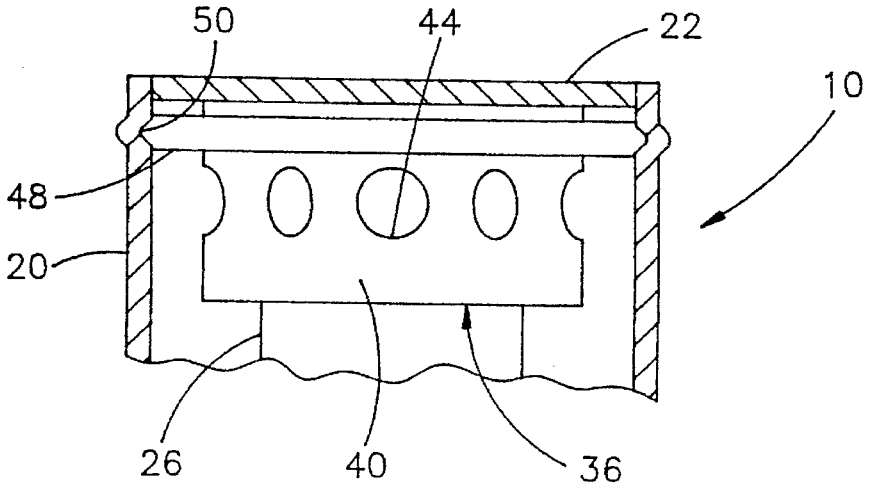
FIG. 3 is a view, similar to that of FIG. 2 showing a mounting ring for securing a resonator support in thermal contact with an end wall of the upper cavity.

With reference to FIGS. 1–3, there is shown a dual mode, dielectric resonator filter 10 operative in the $TE_{11\delta}$ hybrid mode. The filter 10 has two cavities, namely, an upper cavity 12 and a lower cavity 14 which are separated by a transverse wall 16 having a cruciform iris 18 for coupling electromagnetic power between the two cavities 12 and 14. It is noted that the terms upper and lower are used only for convenience in identifying the cavities, and that the filter 10 may be oriented in any desired orientation. The filter 10 further comprises a circular cylindrical sidewall 20 which is terminated by an upper end wall 22 and a lower end wall 24. The transverse wall 16 is secured to the sidewall 20 at the center of the sidewall 20. The upper cavity 12 is bounded by the sidewall 20, the upper end wall 22 and the transverse wall 16. The transverse wall 16 is secured to the sidewall 20 at the center of the sidewall 20. The lower cavity 14 is bounded by the sidewall 20, the lower end wall 24 and the transverse wall 16. This gives each of the cavities 12 and 14 the shape of a right circular cylinder. The cavity walls are fabricated of an electrically and thermally conductive material, a suitable material being a metal such as aluminum, brass, or invar.

An upper dielectric resonator 26 is disposed in the upper cavity 12 and is centered along a central axis 28 (shown in FIG. 2) of the filter 10. A lower dielectric resonator 30 is disposed in the lower cavity 14 and is centered along the central axis 28. The resonators 26 and 30 are fabricated of a high dielectric ceramic material such as rutile, barium tetratitanate, or zirconium stannate. Each of the resonators 26 and 30 has a flat circular base surface 32 and a cylindrical side surface 34. Each base surface 32 is perpendicular to the central axis 28.

In accordance with a feature of the invention, the upper resonator 26 is positioned in the upper cavity 12 by means of an upper support 36, and the lower resonator 30 is positioned in the lower cavity 14 by means of a lower support 38. Each of the supports 36 and 38 is fabricated of an electrically insulating, thermally conductive, low dielectric and low loss material such as boron nitride. The two supports 36 and 38 have the same shape, and each comprises a cylindrical wall 40 with an inner spiral thread 42 (shown in FIG. 1 only for the lower support 38) and a set of windows 44. Each of the resonators 26 and 30 is provided with a spiral thread 46 (shown in FIG. 1 only for the lower resonator 30) which mates with the thread 42 of the respective one of the supports 36 and 38. By means of the threads 42 and 46, the supports 36 and 38 are readily connected to the respective resonators 26 and 30. The upper support 36 is mounted to the upper end wall 22 and held in thermal contact therewith by means of a ring 48 (shown in FIG. 3) which tightly encircles the upper support 36 and is secured to the filter 10 by means of a circumferential groove 50 in the sidewall 20. A similar ring 48 (not shown in the drawing) is employed to secure the lower support 38 in thermal contact with the lower end wall 24. Each of the rings 48 is fabricated of an electrically insulating, low loss material, preferably a plastsic such as polystyrene, by way of example.

The supports 36 and 38 are operative to extract heat from their respective resonators 26 and 30, and to conduct the heat to the respective end walls 22 and 24 from which the heat radiates to the environment outside the filter 10. This conduction of heat away form the resonators 26 and 30 maintains the resonators at an adequately cool operating temperature, even in the presence of elevated electromagnetic power, so as to enable the filter 10 to operate with elevated electromagnetic power.

In accordance with a further feature of the invention, the filter 10 may be provided with tuning and mode coupling screws, in which case the supports 36 and 38 allow positioning of the screws behind the respective resonators 26 and 30 within the regions of the respective supports 36 and 38. By way of example, FIG. 1 shows a first tuning screw 52, located in the upper cavity 12, and oriented parallel to a slot 54 of the iris 18 for interaction with a horizontally polarized wave, and a second tuning screw 56, located in the upper cavity 12, and oriented parallel to a slot 58 of the iris 18 for interaction with a vertically polarized wave. A mode coupling screw 60, located in the upper cavity 12, is oriented in a direction of 45 degrees relative to the slots 54 and 58 so as to provide for coupling of energy between the vertically and horizontally polarized waves. Also shown, by way of example, is a further tuning screw 62 located within the lower cavity 14 oriented parallel to the slot 54. The screws are secured by threaded mounts 64 to the sidewall 20, three of the mounts 62 being shown in the figure. While only four of the screws are shown in the drawing, it is to be understood that additional tuning and mode coupling screws may be provided. For example, there may be two tuning screws and one mode coupling screw for each of the cavities 12 and 14.

The tuning screw 52 is disposed in a plane parallel to a base surface 32 of the upper resonator 26 and is located approximately half way between the resonator 26 and the upper end wall 22, as shown in FIG. 2. The tuning screw 56 and the mode coupling screw 60 are coplanar with the tuning screw 52. Similarly, in the case of the tuning screw 62 in the lower cavity 14, the screw is disposed parallel to the base surface of the resonator 30 and to the lower end wall 24, and is located approximately half way between the resonator 30 and the end wall 14. The windows 44 of the supports 36 and 38 are positioned at the locations of the tuning and the mode coupling screws to allow these screws to be inserted, through respective ones of the windows 44, into their respective cavities to any desired amount without interference with the wall 40 of a support. In order to provide space for the support and resonator within a cavity, the cavity is elongated to an axial length approximately three times the axial length of the resonator. For example, the length of a cavity, as measured along the axis 28, may be one inch, while the corresponding dimension of the resonator is approximately one-third inch. The locating of the screws behind a resonator, in the space between a resonator and an end wall of a cavity, permits the screws to be distanced from the resonator a sufficient amount to inhibit electric discharge between a screw and a resonator, even in the presence of elevated electromagnetic power. This also enables the filter 10 to operate with elevated electromagnetic power.

A coupling probe, such as a coaxial probe 66 having a center conductor 68, may be mounted on the sidewall 20 facing a window 44 of a support, such as the upper support 36, as shown in FIG. 1. The window 44 provides space, if necessary, to accommodate the conductor 68. The probe provides for a coupling of power into or out of the upper cavity 12. A similar probe, not shown, may be mounted in the same fashion to the sidewall 20 at a location facing a window 44 of the lower support 38 for coupling power into or out of the lower cavity 14.

Thereby, the invention enables the filter 10 to accommodate a substantial increase in electromagnetic power, approximately ten times that possible heretofore with dielectric resonator filters. This advantage of the invention is accomplished by the foregoing functions of heat removal and the distancing of the screws form the resonators to inhibit electric discharge.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A filter comprising:

at least a first cavity and at least a first dielectric resonator and at least a first support for supporting said first resonator within said first cavity, said first cavity being formed of an electrically conductive sidewall and comprising an end wall connecting with said sidewall, said end wall being electrically conductive and thermally conductive;

wherein said first support is disposed within said cavity between said resonator and said end wall, said support making thermal contact with a wall of said cavity and with a surface of said resonator, said support having a cylindrical shape including a cylindrical wall extending from said end wall, and said support being formed of a material which is electrically insulating and thermally conductive for extraction of heat from said resonator; and said gripping means includes a thread extending along a periphery of said cylindrical wall for engaging an outer surface of said first resonator.

2. A filter according to claim 1 wherein the material of said first support is born nitride.

3. A filter according to claim 1 wherein said first support includes means for gripping said first resonator.

4. A filter according to claim 3 wherein the outer surface of said first resonator has a thread for engaging with the thread of said first support.

5. A filter according to claim 4 wherein said first support has a circular cylindrical shape, and the outer surface of said first resonator has a circular cylindrical shape.

6. A filter according to claim 1 wherein said support is mounted to said end wall.

7. A filter comprising:

at least a first cavity and at least a first dielectric resonator and at least a first support for supporting said first resonator within said first cavity, said first cavity being formed of an electrically conductive sidewall and comprising an end wall connecting with said sidewall, said end wall being electrically conductive and thermally conductive;

wherein said first support is disposed within said cavity between said resonator and said end wall, said support making thermal contact with a wall of said cavity and with a surface of said resonator, said support having a cylindrical shape including a cylindrical wall extending from said end wall, and said support being formed of a material which is electrically insulating and thermally conductive for extraction of heat from said resonator;

said filter further comprises at least a first tuning screw mounted to said cavity sidewall and extending radially inward of said cavity sidewall, said first resonator has an end surface facing said cavity end wall, said first screw being located between said first resonator and said cavity end wall; and said first support has at least a first window in said cylindrical sidewall to permit passage of said screw via said window to a position spaced apart from the end surface of said first resonator to inhibit generation of an electric discharge arc.

8. A filter according to claim 7 further comprising coupling means extending through said cavity sidewall for coupling electromagnetic power into said first cavity, said coupling means being located between the end surface of said first resonator and said cavity end wall and extending through a window of said first support.

9. A filter according to claim 8 wherein the sidewall of said first support has a plurality of windows including said first window, the filter further comprises a mode coupling screw mounted to said cavity sidewall and extending radially inward of said cavity sidewall, said mode coupling screw extending through a window of said support, wherein said first screw is aligned with a plane of polarization of an electromagnetic field for tuning a mode of the filter and said mode coupling screw is oriented at approximately 45 degrees relative to the plane of polarization for coupling between two modes of the filter.

10. A filter according to claim 1 further comprising a second cavity and a second dielectric resonator and a second support for supporting said second resonator within said second cavity, said second cavity being formed of an electrically conductive sidewall and comprising an end wall connecting with said sidewall, said end wall of said second cavity being electrically conductive and thermally conductive;

wherein said second support is disposed within said second cavity between said second resonator and said end wall of said second cavity, said second support making thermal contact with a wall of said second cavity and with a surface of said second resonator, said second support having a cylindrical shape including a cylindrical wall extending from said end wall of said second cavity, and said second support being formed of a material which is electrically insulating and thermally conductive for extraction of heat from said resonator; and said filter comprises a further end wall disposed between said first cavity and said second cavity, and an iris disposed in said further end wall for coupling electromagnetic power between said first cavity and said second cavity.

11. A filter comprising:

at least a first cavity and at least a first dielectric resonator and at least a first support for supporting said first resonator within said first cavity, said first cavity being formed of an electrically conductive sidewall and comprising an end wall connecting with said sidewall, said end wall being electrically conductive and thermally conductive; and wherein said first support is disposed within said cavity between said resonator and said end wall, said support making thermal contact with a wall of said cavity and with a surface of said resonator, said support having a cylindrical shape including a cylindrical wall extending from said end wall, and said support being formed of a material which is electrically insulating and thermally conductive for extraction of heat from said resonator;

said filter further comprises a second cavity and a second dielectric resonator and a second support for supporting said second resonator within said second cavity, said second cavity being formed of an electrically conductive sidewall and comprising an end wall connecting with said sidewall, said end wall of said second cavity being electrically conductive and thermally conductive;

said second support is disposed within said second cavity between said second resonator and said end wall of said second cavity, said second support making thermal contact with a wall of said second cavity and with a surface of said second resonator, said second support having a cylindrical shape including a cylindrical wall extending from said end wall of said second cavity, and said second support being formed of a material which is electrically insulating and thermally conductive for extraction of heat from said resonator;

said filter comprises a further end wall disposed between said first cavity and said second cavity, and an iris disposed in said further end wall for coupling electromagnetic power between said first cavity and said second cavity;

each of said supports has a circular cylindrical shape, and the outer surface of each of said resonators has a circular cylindrical shape;

said first support is mounted to the end wall of said first cavity and said second support is mounted to the end wall of said second cavity;

the filter further comprises at least a first tuning screw mounted to said first cavity sidewall and a second tuning screw mounted to said second cavity sidewall, said tuning screws extending radially inward of the sidewalls of the respective ones of said first and said second cavities, said first resonator having an end surface facing said first cavity end wall and said second resonator having an end surface facing said second cavity end wall, said first tuning screw being located between said first resonator and said first cavity end wall, said second tuning screw being located between said second resonator and said second cavity end wall; and wherein each of said supports has at least a first window in said cylindrical sidewall to permit passage of a respective one of said tuning screws via said window to a position spaced apart from the respective end surfaces of said resonators to inhibit generation of an electric discharge arc.

12. A filter according to claim 11 further comprising first and second coupling means extending through respective ones of said cavity sidewalls for coupling electromagnetic power into respective ones of said cavities;

wherein, in each of said cavities, one of said coupling means is located between the end surface of a respective one of said resonators and a respective one of said cavity end walls and extending through a window of a respective one of said supports.

13. A filter according to claim 12 wherein the sidewall of said first support has a plurality of windows including said first window, the filter further comprises a first mode coupling screw mounted to said first cavity sidewall and extending radially inward of said first cavity sidewall, said mode coupling screw extending through a window of said first support;

said first tuning screw is aligned with a plane of polarization of an electromagnetic field for tuning a mode of the filter and said first mode coupling screw is oriented at approximately 45 degrees relative to the plane of polarization for coupling between two modes of the filter;

the sidewall of said second support has a plurality of windows including said first window, the filter further comprises a second mode coupling screw mounted to said second cavity sidewall and extending radially inward of said second cavity sidewall, said mode coupling screw extending through a window of said second support; and said second tuning screw is aligned with a second plane of polarization of an electromagnetic field for tuning a mode of the filter and said second mode coupling screw is oriented at approximately 45 degrees relative to the second plane of polarization for coupling between two modes of the filter.

14. A filter according to claim 13 wherein the material of said first support and said second support is born nitride;

each of said supports includes means for gripping a respective one of said resonators;

each of said gripping means includes a thread for engaging an outer surface of a respective one of said resonators; and the outer surfaces of respective ones of said resonators have threads for engaging with the threads of respective ones of said supports.

* * * * *